United States Patent [19]

Messmer

[11] 3,954,543

[45] May 4, 1976

[54] LABEL APPLICATOR

[76] Inventor: Edwin E. Messmer, 203 Leonard Young St., Oradell, N.J. 07649

[22] Filed: Sept. 15, 1972

[21] Appl. No.: 289,400

[52] U.S. Cl. ..... 156/363; 156/485; 156/DIG. 3; 156/DIG. 19; 156/DIG. 46; 156/542

[51] Int. Cl.[2] ..... B65C 9/42

[58] Field of Search ..... 156/476, 477, 483, 486, 156/540-542, 358, 362, 363, 484, 481, 485, 566, DIG. 3, DIG. 19, DIG. 42, DIG. 45, DIG. 46; 93/93, 1 E, 54.2, 54, 54.3

[56] References Cited

UNITED STATES PATENTS

| | | | |
|---|---|---|---|
| 1,981,366 | 11/1934 | Malocsay | 156/476 |
| 2,267,549 | 12/1941 | Bronander | 156/484 |
| 2,759,283 | 8/1956 | Bowman et al. | 156/542 |
| 2,832,164 | 4/1958 | Hall et al. | 156/358 |
| 3,284,982 | 11/1966 | Conti | 156/485 |
| 3,345,237 | 10/1967 | Browning et al. | 156/566 |
| 3,362,863 | 1/1968 | Larsson et al. | 156/486 |
| 3,429,764 | 2/1969 | Bragga, Jr. | 156/542 |
| 3,673,043 | 6/1972 | Carter | 156/486 |
| 3,679,522 | 7/1972 | Anderegg et al. | 156/477 |
| 3,783,077 | 1/1974 | Messmer | 156/364 |

*Primary Examiner*—William A. Powell
*Assistant Examiner*—Jerome W. Massie
*Attorney, Agent, or Firm*—Alan H. Levine

[57] ABSTRACT

Apparatus for applying labels bearing a pressure-sensitive adhesive to articles wherein each article is moved by a first pair of conveyor belts into engagement with a second pair of conveyor belts. The first and second pair of conveyor belts hold and move the articles. As the articles are moved, each article passes a sensor, such as an electric eye, which actuates label feeding means, thereby causing a label to be moved into the path of travel of the article. The leading edge of the moving article engages the label between the label ends and moves the label against a pair of spaced rollers. As the article is moved through the space between the rollers, the rollers press the leading end of the label and the center of the label against the bottom and top surface of the article, respectively. Thereafter, another sensor, such as an electric eye responds to the trailing edge of the moving article and activates a tucker which bends the trailing end of the label around the trailing edge and bottom of the article so that the trailing end of the label adheres to the bottom of the article and the leading end of the label. Subsequently, as the article moves through a space between a second pair of rollers, the rollers press the label against the bottom and top surface of the article and the overlapping ends of the label to each other, thereby securing the label to the article. The speeds of the first pair of conveyor belts, the second pair of conveyor belts, and the label feeding means are all independently adjustable.

20 Claims, 11 Drawing Figures

LABEL APPLICATOR

The subject invention relates to apparatus for applying labels to articles.

It is an object of the invention to provide an apparatus for applying a label partially or completely around an article so that the label on the article is bent into more than one plane.

It is another object of the invention to provide such an apparatus for applying labels around articles which are non-circular, e.g., rectangular boxes.

It is a further object of the invention to provide such an apparatus for applying labels around articles which are limp, e.g., pairs of socks.

It is still another object of the present invention to provide such a label applicator for applying labels to articles at variable rates.

To achieve some of the objectives mentioned above and others, the invention employs means for feeding articles; means for feeding labels into the path of travel of the articles so that the leading edge of each article engages a label between the ends of the label; and means for pressing engaged labels to the top and bottom surfaces of the article with which it is engaged.

The above mentioned and other objects and features of this invention will become apparent by reference to the following description in conjunction with the accompanying drawings, in which:

FIG. 1 shows the parts of the label applicator, chosen to illustrate the present invention, which are directly involved in applying a label to an article.

Figure 1:
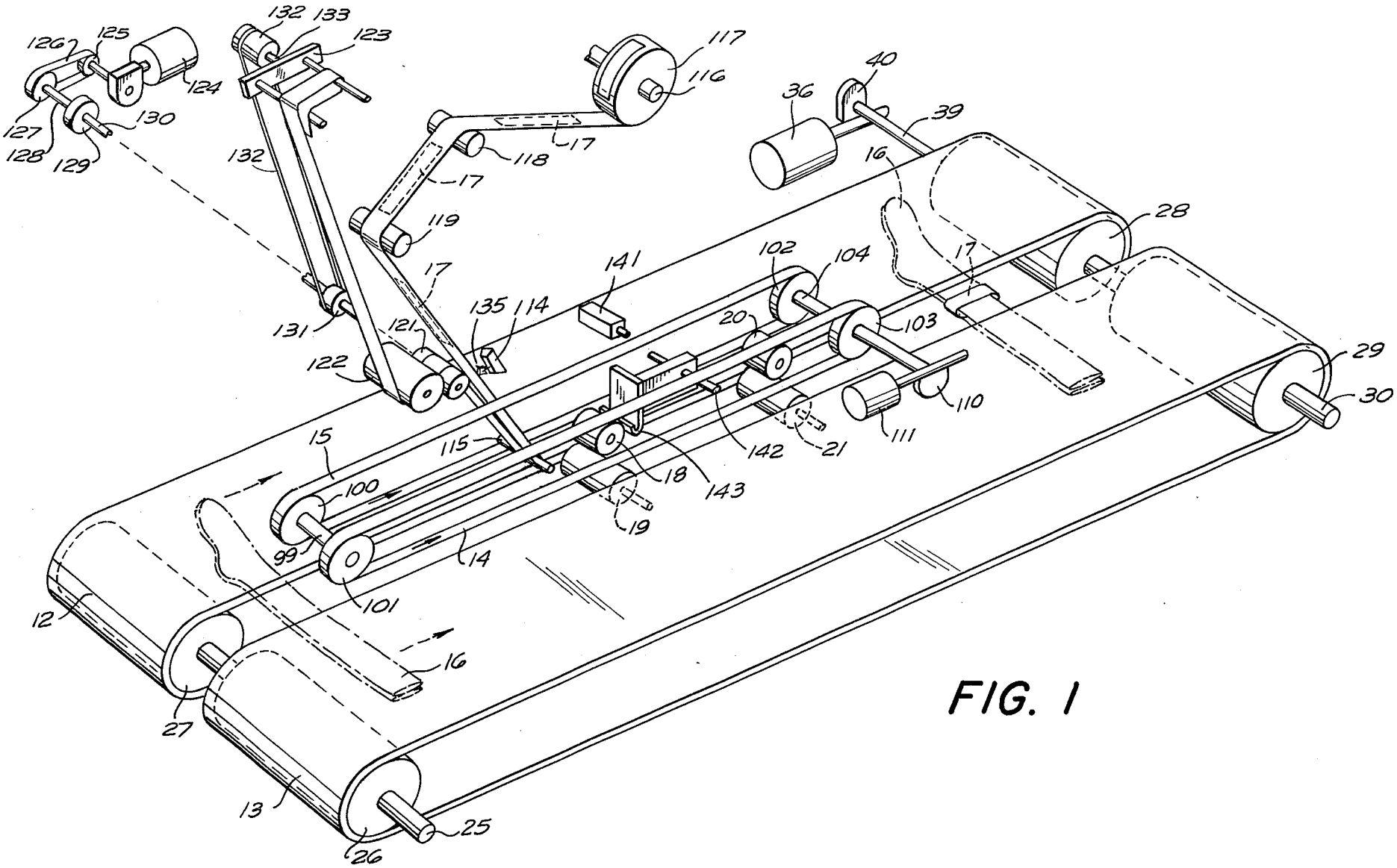
FIG. 1 is a perspective view of a label applicator according to the invention, the framework having been omitted to clearly show the major operating parts of the invention.

The label applicator includes, in general, a first or lower pair of conveyor belts 12 and 13, and a second or upper pair of conveyor belts 14 and 15. The first and second pair of conveyor belts 12–15 are used to engage and move articles, of which pairs of socks 16 are representative, along a substantially linear path which in this example is horizontally disposed. As each pair of socks 16 moves along the horizontal path, means for feeding labels 17 detect the presence of the moving pair of socks 16 and move one of the labels into its path. If desired, the previous label movement could terminate after a label has moved into the path of the next-to-be fed pair of socks, and label movement reinitiated by the sock detection means when the next pair of moving socks is sensed. The leading edge of the moving pair of socks 16 engages the label between the ends of the label (see FIG. 4) and moves into engagement with rollers 18 and 19 (see FIG. 5). Rollers 18 and 19 are part of means for pressing the engaged label to the top and bottom surfaces of the pair of socks. Accordingly as the pair of socks move, the leading edge of the label 17 is pressed to the bottom of the pair of socks, and the mid-section of the label 17 is pressed against the top of the pair of socks (see FIGS. 1 and 5). Subsequently, the trailing end of the pair of socks is sensed by an electric eye or similar switching means to activate means which tuck the trailing edge of the label 17 against the bottom of the pair of socks 16, and if the label is long enough cause the trailing label end to overlap the leading label end. Thereafter, another pair of rollers 20 and 21 (FIGS. 1 and 8) press the label 16 against itself and the pair of socks 16, thereby securing the label to the pair of socks. After the above-described sequence has taken place, the labeled pairs of socks are discharged by the conveyor belts 12–15 on to a collector means (not shown).

Figure 2:
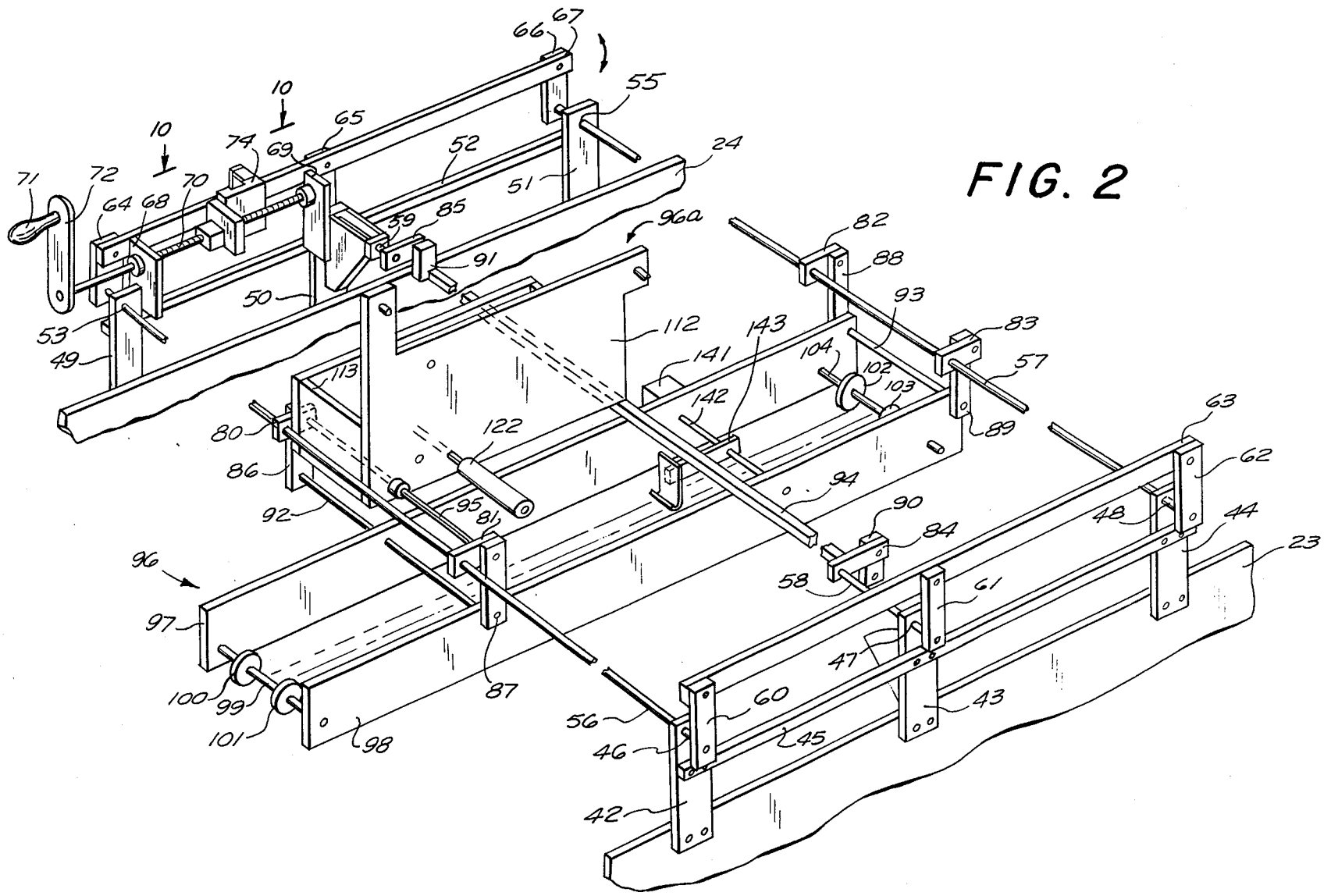
FIG. 2 is a perspective view of part of the framework of the label applicator and a movable carriage supported by the framework.
Figure 9:
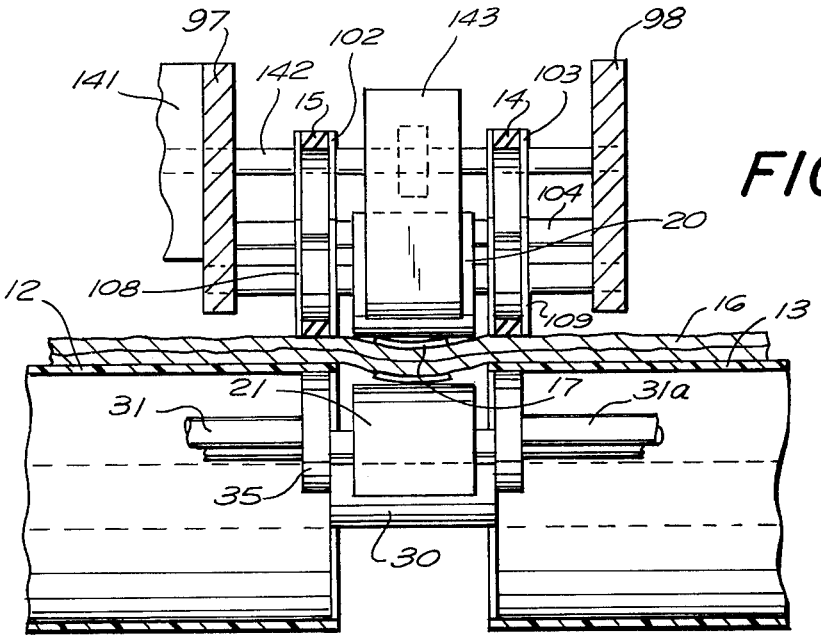
FIG. 9 is a fragmentary vertical cross-sectional view of the label applicator, taken along line 9—9 in FIG. 6.

More particularly, a base (not shown) supports a vertical side plate 23 and a vertical side plate 24, the plates being parallel to each other (see FIG. 2). Referring to FIG. 1, each vertical plate 23 and 24 rotatably supports an end of a rod 25 to which there is connected a pair of spaced idler pulleys 26 and 27. In addition, each vertical plate 23 and 24 rotatably supports an end of a rod 30 to which there is connected a pair of spaced drive pulleys 28 and 29, the spacing between pulleys 28 and 29 being substantially the same as the space between the pulleys 26 and 27. The rods 25 and 30 are perpendicularly located between the vertical side plates 23 and 24 and lie in a horizontal plane. The pulleys 26–29 have equal diameters and, consequently, the spaced conveyor belts 12 and 13, which are supported by pulleys 27 and 28, and 26 and 29, respectively, have oblong shapes, the long sides of which are horizontally disposed. To keep the inner margin of the top part of the oblong conveyor belt 12 from sagging, the vertical side 24 rotatably supports an end of each of four spaced shafts 31 carrying rollers 32–35, respectively, whose circumferences are substantially tangent to the lower surface of the top part of the belt 12 (see FIGS. 3 and 9). Similarly, and for the same purpose, belt 13 is supported by four spaced rollers, **32*a*–35*a* (not all shown), carried by shafts 31*a* supported by side 23. The rollers 32–35 and 32*a*–35*a* are located parallel with respect to the pulleys 26–29, and a variable speed motor 36 drives the pulleys 28 and 29. The vertical side plate 24, shown in FIG. 2, supports the variable speed motor 36 (see FIG. 1), and the output shaft of the motor 36 is connected to an extension 39 of rod 30 by a transmission 40. Thus, when the motor 36 is turned on, it drives the conveyor belts 12 and 13 at selected speeds, thereby providing control over the rate at which the pairs of socks are moved into the label feeding and tucking means of the overall machine. The vertical side plates 23 and 24 also serve to support the rollers 19 and 21. In particular, the roller 19 includes a rod whose ends are rotatably supported by the vertical side plates 23 and 24, and a cylinder fixed to the rod. The length of the cylinder is less than the space between the belts 12 and 13 and is located between the belts. Roller 21 is similarly constructed and located (see FIGS. 1 and 9), rollers 19 and 21** being parallel with respect to each other.

To enable the label applicator to be used on articles having various sizes and shapes, the conveyor belts 14 and 15, part of the label feeding means, part of the tucking means, and part of the pressing means are located on a movable frame, a description of which is set forth below.

Referring to FIG. 2, the vertical side plate 23 supports three spaced brackets 42–44 which extend vertically from the top part of the side plate 23. The brackets 42–44 are fixed to a horizontally disposed load distributing brace 45 and each bracket 44–45 includes a hole 46–48, respectively. Similarly, the vertical side plate 24 supports three spaced brackets 49–51 which extend vertically from the top part of the side plate 24. The brackets 49–51 are fixed to a horizontally disposed load distributing brace 52. As with brackets 42–44, bracket 49 includes a hole 53, bracket 50 includes a hole (not shown) and bracket 51 includes a hole 55. Brackets 42 and 49 rotatably support a circular rod 56 which extends through holes 46 and 53, and brackets 44 and 51 rotatably support a circular rod 57 which extends through holes 48 and 55. Bracket 43 rotatably supports a circular rod 58 which extends through hole 47, and bracket 50 supports a circular rod 59 which extends through a hole (not shown) in the bracket 50. The circular rods 56–59 are perpendicularly located with respect to the vertical side plates 23 and 24 and lie in a horizontal plane above the conveyor belts 12 and 13.

Three identical links 60–62 are fixed, respectively, to the ends of the rods 46–48 which extend past the outside surface of the vertical wall 23. In addition, the links 60–62 are pivotally connected to a drive link 63 so that rotation of any one of the rods 56–58 causes the remaining two to rotate a similar amount. Similarly, three identical links 64–66 are fixed, respectively, to the ends of the rods 56, 59, 57 which extend past the outside surface of the vertical wall 24. The links 64–66 are pivotally connected to a drive link 67 so that rotation of any one of the rods 56, 59, 57 causes the remaining two to rotate a similar amount. Thus, it may be seen that rods 56–59 are rotatable simultaneously.

Figure 10:
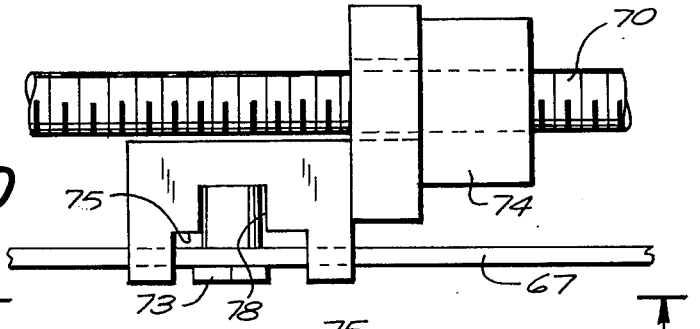
FIG. 10 is a fragmentary top view of the label applicator, taken along line 10—10 in FIG. 2.
Figure 11:
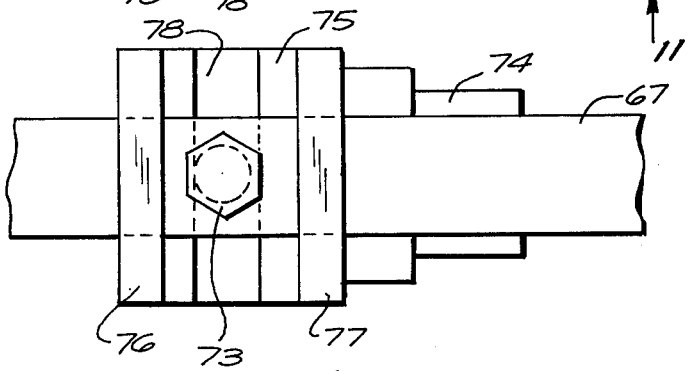
FIG. 11 is a fragmentary side view of the label applicator, taken along line 11—11 in FIG. 10.

To facilitate rotation of the rods 56–59, brackets 49 and 50 support respectively, members 68 and 69. Members 68 and 69 support a lead screw 70 to an end of which there is connected by a link 72 a handle 71. As shown in FIGS. 2, 10, and 11, the lead screw 70 is located parallel to drive link 67, and is coupled to it by a screw 73 fixed to the drive link 67 and a threaded member 74 engaged with the lead screw 70. The threaded member 74 includes a vertically disposed surface 75 which is parallel to the drive link 67 and includes a vertical groove 78 into which the screw 73 extends, the head of the screw being mounted against the outside vertical surface of the drive link 67. In addition, the threaded member 74 includes a pair of U-shaped extensions 76 and 77 which slidably capture the drive link 67 on both sides of the screw 71, thereby securing the coupling. Thus, when the handle 71 is initially rotated, the lead screw 70 moves threaded member 74 along the length of the screw, and a side of the groove 78 abuts against screw 73. Thereafter, additional rotation of the handle 71, in the same direction, causes screw 73 and hence drive link 67 to move in the direction threaded member 74 moves causing rotation of the brackets 64–66. If the handle 71 is rotated as above, but in the opposite direction, the direction of rotation of the brackets 64–66 is reversed. Rotation of the brackets 64–66 causes the rods 56–59 and the brackets 42–44 to rotate simultaneously.

Between the vertical walls 23 and 24, rod 56 rigidly supports two spaced and parallel links 80 and 81. Similarly, rod 57 rigidly supports two spaced and parallel links 82 and 83, the direction in which the links 82 and 83 extend being the same as the direction in which the links 80 and 81 extend. The ends of the rods 58 and 59, located between the vertical walls 23 and 24, also rigidly support, respectively, links 84 and 85. Links 84 and 85 extend in the same direction as links 80–83, and each of the links 80–85 pivotally supports a downwardly-extending link 86–91, respectively. Links 86 and 87 each rotatably support an end of a horizontal circular rod 92, and links 88 and 89 each rotatably support an end of a horizontal circular rod 93. The rods 92 and 93 are parallel with respect to rods 56 and 57 and pivotally support a carriage 96, more fully described below, which carries the upper conveyor belts 14 and 15. However, it should be noted that rotation of the handle 71 may be used to raise and lower the rods 56 and 57 and the carriage 96. Links 90 and 91 rigidly support the ends of a square rod 94 parallel to circular rods 58 and 59, and links 80 and 81 rigidly support the ends of a circular rod 95. Rods 94 and 95 support a carriage **96*a*, more fully described below, for the label feeding means. Therefore, rotation of the handle 71 also serves to raise and lower the carriage 96*a* for the label feeding means. It should be noted that when handle 71 is rotated both carriages 96 and 96*a*** are simultaneously raised or lowered.

It will be seen, therefore, that by rotating handle 71, the vertical spacing between the upper pair of conveyor belts 14 and 15 and the lower pair of belts 12 and 13 can be varied to accommodate articles of different heights. Furthermore, since links 86–89 always hang vertically from their respective links 80–83, the upper pair of conveyor belts 14 and 15 always remain parallel to the lower pair of conveyor belts 12 and 13 throughout the adjustment of vertical spacing between the belts.

Figure 3:
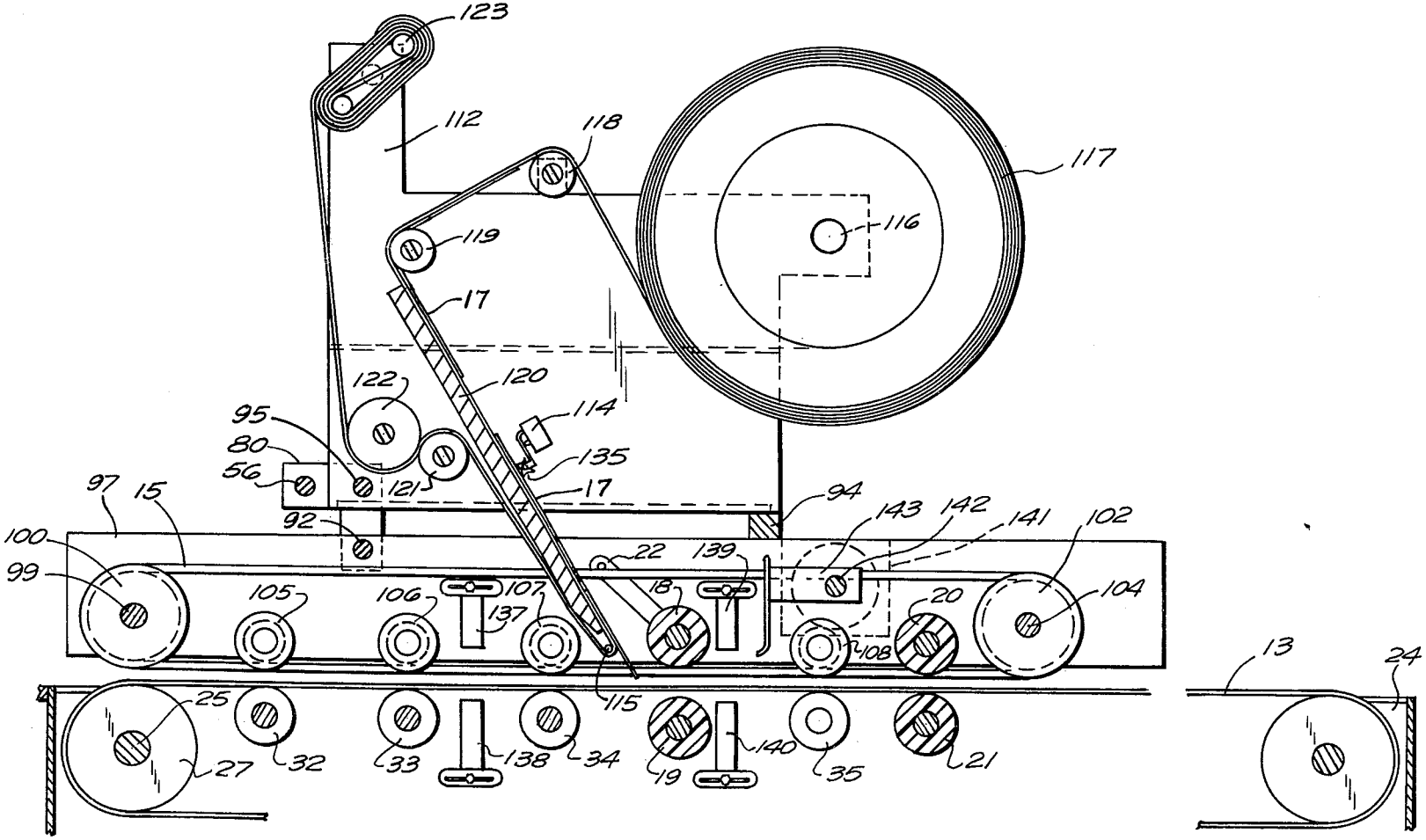
FIG. 3 is a vertical cross-sectional view of the upper part of the label applicator.

Referring to FIGS. 1, 2 and 3, the conveyor belt carriage 96 includes a pair of vertically disposed rectangular plate members 97 and 98 which are fixed parallel to each other and are parallel to the vertical side plates 23 and 24. Each of the plate members 97 and 98 rotatably supports an end of a circular rod 99 to which there is connected a pair of spaced idler pulleys 100 and 101. In addition, each plate member rotatably supports an end of a rod 104 to which there is connected a pair of spaced drive pulleys 102 and 103 (see also FIG. 9). The circular rods 99 and 104 are perpendicularly located between the plate members 97 and 98 and lie in a horizontal plane. The pulleys 100–103 have equal diameters and, consequently, the conveyor belts 14 and 15, which are supported by the pulleys 101 and 103, and 100 and 102, respectively, have oblong shapes, the long sides of which are horizontally disposed. To keep the bottom part of the oblong conveyor belts 14 and 15 substantially flat, the plate member 97 rotatably supports an end of each of four spaced shafts carrying idler pulleys 105– 108, respectively, whose circumferences are substantially tangent to the upper surface of the bottom part of the belt 15 (see FIGS. 3 and 9). Similarly, and for the same purpose, belt 14 is supported by four spaced idler pulleys 109 (not all shown). The pulleys 105–109 are located so that their axes of rotation are parallel to the axes of rotation of pulleys 100–103, and a variable speed motor 111 drives the pulleys 100–103. The plate member 98 supports the variable speed motor 111 (see FIGS. 1, and 2) and the output shaft of the motor is connected to an extension of circular rod 104 by a transmission 110. Thus, when the motor 111 is turned on it drives the upper spaced conveyor belts 14 and 15 at selected speeds. Normally, the linear speeds of the conveyor belts 12 and 13 and belts 14 and 15 are set to be equal, but this is not always the case, as will be mentioned below.

Referring to FIGS. 1, 2, and 3, the carriage **96*a* for label feeding means includes a vertical plate member 112 and a housing 113 fixed to part of one side of the vertical plate member 112. Circular rod 95 pivotally extends through a hole in the housing 113 and through a hole in vertical plate member 112, and square rod 94 supports from underneath the other end of the housing 113 and vertical plate member 112. Thus, when the links 80, 81, 84, 85 are rotated, the carriage 96*a*** is lifted or lowered.

Referring to FIGS. 1 and 3, the vertical plate member 112 supports a rectangular plate 120 extending perpendicularly from the plate member 112 and at an acute angle with respect to the conveyors 12–15. Plate 112 supports adjacent to the upper face of plate 120, and at its lower end plate 120 carries a pair of brackets (not shown) which support a rod 115. The vertical plate 112 rotatably supports a rod 116 which is loaded with a wound ribbon 117 carrying a supply of labels 17. The labels are of the type having a pressure-sensitive adhesive on one face, and are readily peelable from the ribbon 117. Vertical plate 112 also supports, above the upper end of the rectangular member 120, a pair of rollers 118 and 119, for guiding the ribbon 117; a pair of nip rollers 121 and 122 for drawing the ribbon 117 from the wound roll; and a driven take-up member 123. As shown in FIG. 3, the ribbon 117 is guided downwardly against the upper surface of the rectangular member 120, continues past the microswitch 114, and has its direction of travel sharply reversed by the rod 115. The sharp reversal of the direction of travel of ribbon 117 causes the labels 17 to peel themselves away from the ribbon 117 and into the path of moving pairs of socks 16 when the ribbon is moved as described below.

A variable speed motor 124 (FIG. 1) is coupled to a belt 126 by a drive pulley 125 connected to the output shaft of the motor 124. The belt 126 drives an idler pulley 127 which is connected by a shaft 128 to an electric clutch and brake combination 129 of conventional design. An output shaft 130 of the clutch and brake 129 is connected to the roller 121 and also drives a drive pulley 131. The drive pulley 131 drives a belt 132 which is coupled to an idler pulley 132. The idler pulley 132 drives a shaft 133 which is connected to the take-up member 123. Thus, when the shaft 130 is rotated by the clutch 129 the rollers 121 and 122, and the take-up member 123 are driven simultaneously, thereby advancing the ribbon 117 and causing labels 17 to disengage from the ribbon 117 as it moves around the rod 45.

Figure 4:
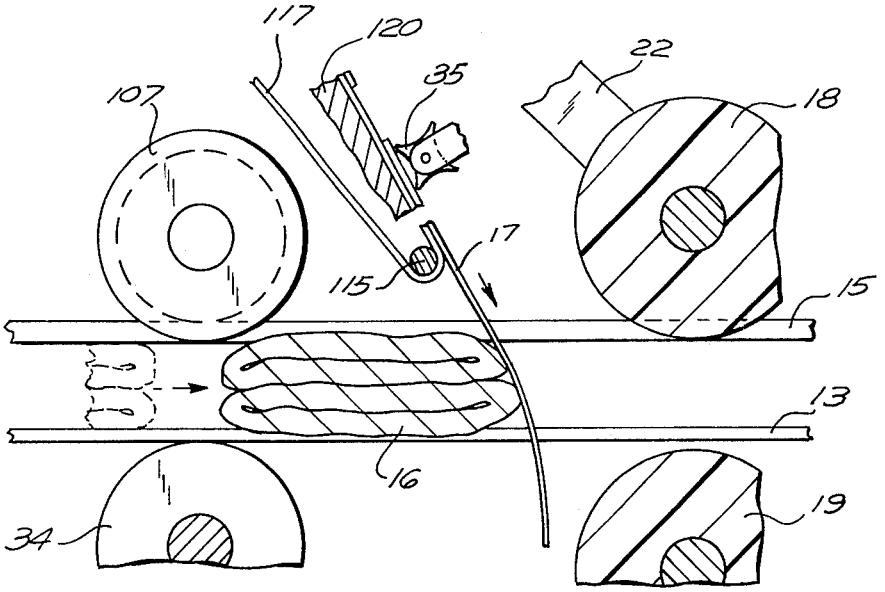
FIG. 4 is a fragmentary cross-sectional view of the label applicator, showing the feeding of a label into the path of a moving pair of socks.

The electric clutch and brake combination 129 is engaged and connects the shaft 128 to the output shaft 130 when an electric eye, or the like, senses a moving pair of socks. In this example of the invention, the plate member 97 supports a photo-electric cell 137 (FIG. 3) between belts 14 and 15 in the region between pulleys 106 and 107. A light source 138, carried by side plate 24, is vertically aligned with photo-electric cell 137. Thus, the cell 137 is able to detect each pair of moving socks which breaks the light beam from source 138, and the cell supplies a signal which causes the clutch of unit 129 to engage and the brake to disengage. The engaged clutch causes the ribbon 117 to be advanced and a label to be fed into the path of movement of the pair of socks which broke the light beam, as shown in FIG. 4.

Figure 5:
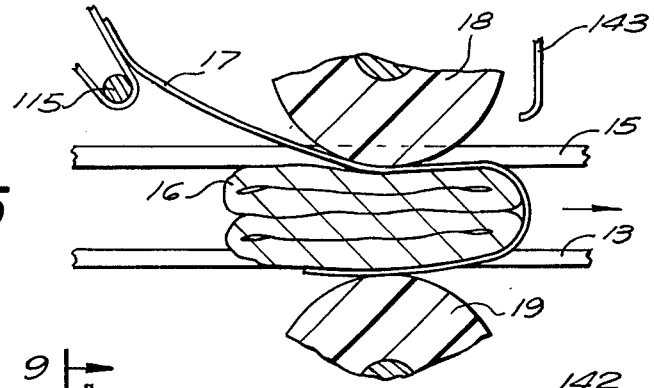
FIG. 5 is a fragmentary cross-sectional view of the label applicator, showing a pair of rollers pressing the label on to the top and bottom surfaces of the moving pair of socks.
Figure 6:
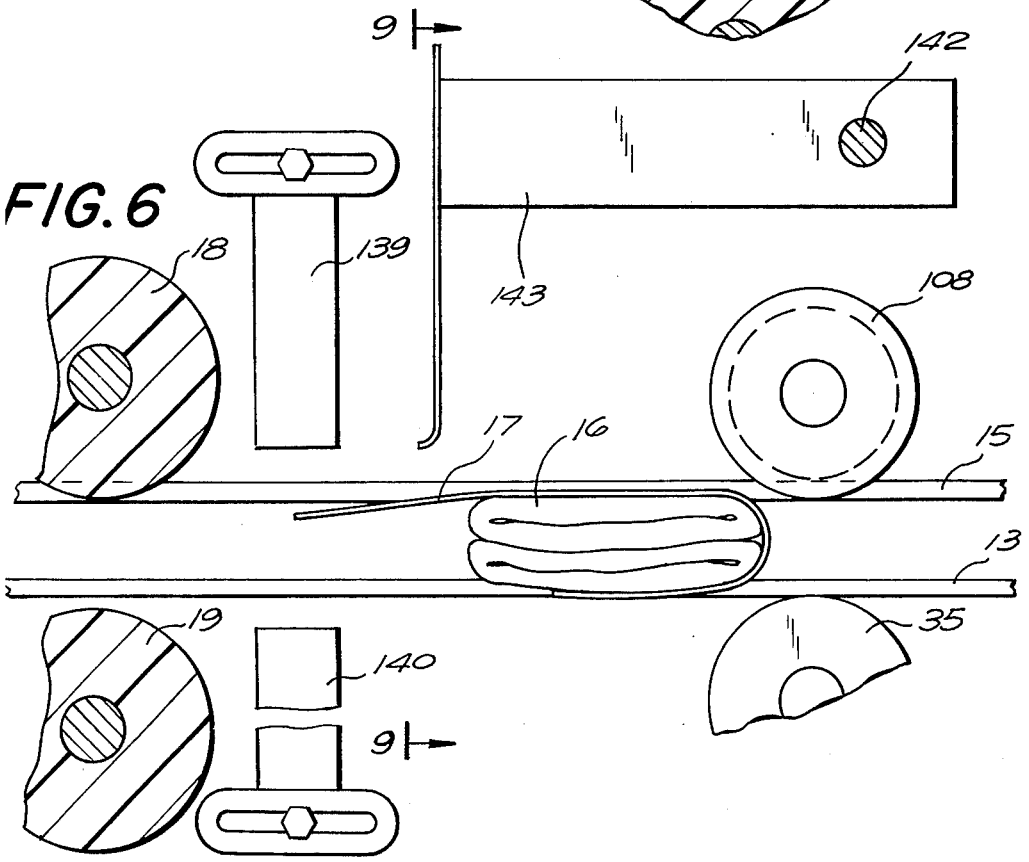
FIG. 6 is a fragmentary cross-sectional view of the label applicator, showing a tucker prior to tucking the trailing edge of the label against the bottom surface of the moving pair of socks.

The microswitch 114 is opened momentarily each time a label 17 is advanced and causes the shaft 128 and the output shaft 130 to disengage. More particularly, as shown in FIG. 4, the microswitch 114 includes a starwheel 135 which is biased against the moving label-bearing ribbon 117. When a label 17 is under the microswitch 114, two teeth of the starwheel 135 slidably engage the label. As the ribbon is advanced, the leading edge of the next label engages one of the teeth of the starwheel. This engagement causes the starwheel 135 to turn, thereby momentarily opening the microswitch 114 and causing the electric clutch to disengage and the electric brake to engage, whereby the advancement of ribbon 117 is halted. Thus, each pair of socks only causes one label 17 to be advanced into its path. It should be noted that the speed with which a label 17 is fed is controlled by the selected speed of the motor 124. Preferably, the label 17 is fed so that the labels have a component of velocity in the direction of the moving pairs of socks which is equal to the velocity of the pair of socks. The label 17 being fed extends into the path of the moving pair of socks and the leading edge of the pair of socks engages the label between its ends (see FIG. 4). Referring to FIGS. 3, 4 and 5, the rectangular plate members 97 and 98 each pivotally support an end of a U-shaped bracket 22 which rotatably supports the roller 18 above the roller 19. As the pair of socks 16 and label 17 move into the space between the rollers 18 and 19, the weight of the roller 18 presses the center of the label to the top of the pair of socks and the leading edge of the label to the bottom of the pair of socks (FIG. 5). The rectangular plate member 97 supports a photo-electric cell 139 between the belts 14 and 15 in the region between the rollers 18 and the idler pulley 108. The photocell 139 and a light source 140 supported by the vertical side plate 24 below the cell 139 comprise part of an electric eye circuit which detects the trailing edge of the moving pair of socks 16 and activates a rotary solenoid 141 (FIGS. 1–3) supported by the plate member 97. The rotary solenoid is coupled to a rod 142 which is rotatably supported at its ends by the plate members 97 and 98, and the rod 142 rigidly supports one end of an L-shaped tucker 143. Thus, when the rotary solenoid is activated by the electric eye, the tucker 143 swings counter clockwise (see FIGS. 6–8) and pushes the trailing edge of the label 17 against the bottom of the moving pair of socks 16, and if the label is long enough, as shown, causes the trailing label end to overlap the leading label end. Each of the plate members 97 and 98 rotatably supports an end of roller 20, roller 20 being substantially tangent to the belts 14 and 15 and above the roller 21. Thus, as the tucked label passes between the rollers 20 and 21 (see FIG. 8), the rollers press the label to the pair of socks and the overlapped ends of the labels to each other. While the rollers 20 and 21 press the label to the pair of socks the solenoid 141 returns the tucker 143 to its initial position.

Figure 7:
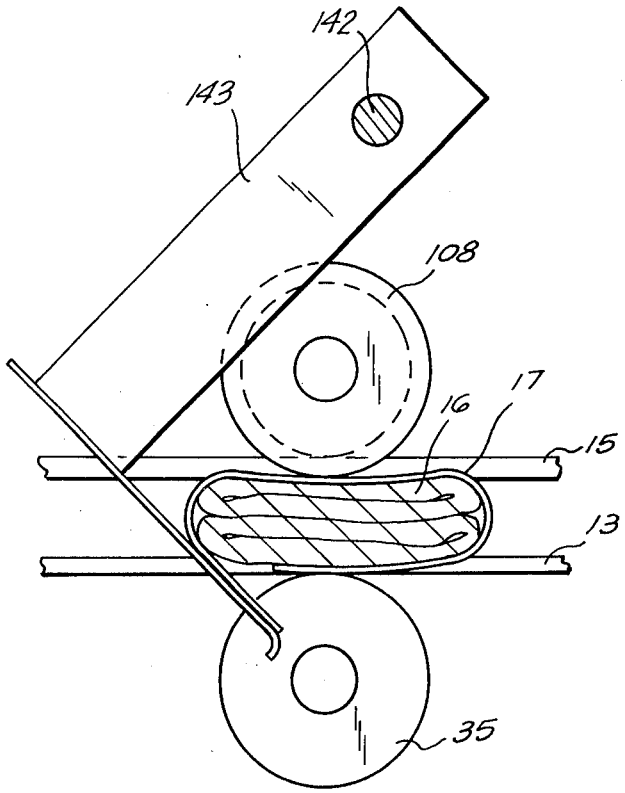
FIG. 7 is a fragmentary cross-sectional view of the label applicator, showing the tucker in the process of tucking the trailing edge of the label on to the bottom surface of the moving pair of socks.
Figure 8:
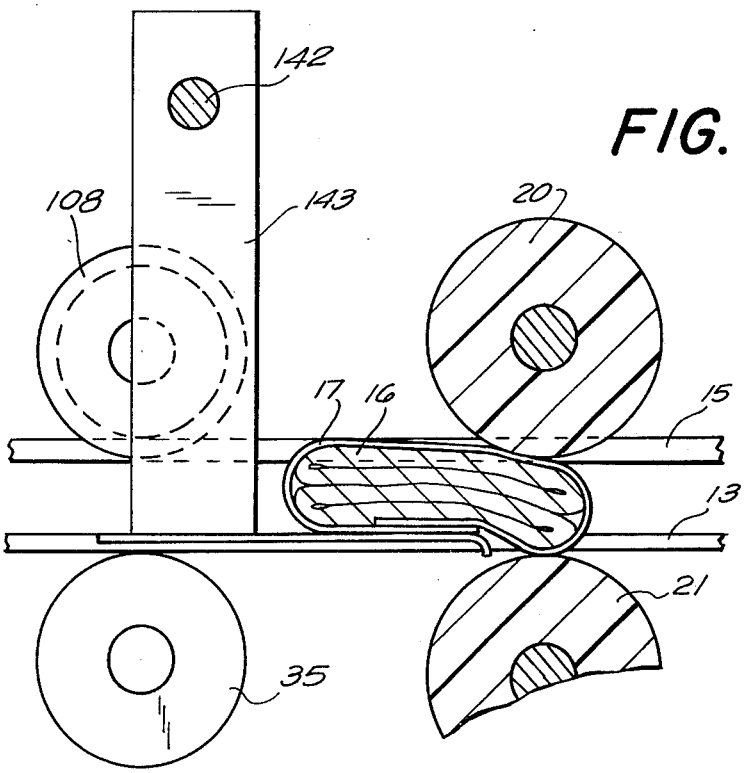
FIG. 8 is a fragmentary cross-sectional view of the label applicator, showing the tucker in its forwardmost position and the entry of the pair of socks between a pair of rollers which press the label on to itself and against the pair of socks.

Normally, the machine is operated as follows. The handle 71 is rotated so that the space between belts 12 and 13 and belts 14 and 15 is about equal to the height of the article to be labeled, or in the case of a compressible article such as the socks 16, is slightly less than the thickness of pairs of socks 16 to be labeled. The speed of motors 36 and 111 are adjusted so that the speed of belts 12 and 13 and belts 14 and 15 are equal and the speed of motor 124 is adjusted so that when it is coupled to shaft 130, the labels 17 are fed having a component of velocity in the direction of the moving belts 12–15 which is equal to their speed. Pairs of socks 16 placed on belts 12 and 13 are moved into engagement with belts 14 and 15. The belts 12–15 hold and move the pairs of socks 16 over the light source 138. Each pair of socks prevents the light from impinging on the photo electric cell 137 and the electric eye causes electrical circuitry (not shown) to engage the clutch 129, thereby causing a label 17 to be fed into the path of the moving socks, as shown in FIG. 4. It should be noted that the microswitch 114 disengages the clutch after a label has been fed, thereby insuring that only one label 17 is advanced per pair of socks 16 sensed. As each moving pair of socks moves into a label and pushes it between the rollers 18 and 19, (see FIG. 5), the rollers 18 and 19 press the label 17 against the bottom and top surfaces of the socks. As the pair of socks continue to move, another electric eye 139 senses the trailing edge of the pair of socks (see FIG. 6) thereby actuating the tucker 143. When the tucker is activated, it swings counterclockwise, as shown in FIGS. 7 and 8, thereby tucking the trailing edge of the label 17 against the bottom of the socks 16. Thereafter, the solenoid actuated tucker moves clockwise in preparation for another tucking operation and the pair of socks 16 move between rollers 20 and 21 (FIG. 8) wherein the label is pressed against the socks. Thereafter, the belts 14 and 15 disengage the labeled pair of socks and the belts 12 and 13 move the pair of socks on to a collector means (not shown) where the labeled pairs of socks are collected.

Although in the label applicator just described the labels are applied to the top and bottom surfaces of the articles, i.e., the pairs of socks, it should be noted that the label applicator may be constructed in such a manner that the belts support the articles by their sides. With such a construction, the labels could, if it is desired, be fed horizontally.

It may be seen in FIG. 3 that the photoelectric cells 137 and 139 and the light sources 138 and 140 are mounted for adjustment longitudinally with respect to the direction of movement of the conveyor belts. By adjusting cell 137 and light 138, socks 16 may be caused to strike label 17 closer to or farther from the leading edge of the label, since electric clutch 129 will be engaged, and the label ribbon movement initiated, when the moving pair of socks is closer to or farther from its point of engagement with the label. By adjusting cell 139 and light 140, the rotary solenoid 141 and hence tucker 143 will be operated at different positions of the socks and hence the label will be wrapped more or less loosely around the socks.

With some articles, it may not be desired to wrap a label completely around the article. In such a case, the tucker 143 need not be used. Instead, the label is sized to fit along only the top, leading edge, and bottom surfaces of the article, and the label is applied as shown in FIGS. 4 and 5. Since no free trailing edge of the label is present in this situation, no tucker is needed to bend the trailing edge around the bottom of the article.

The importance of using two horizontally spaced-apart upper conveyors and similarly spaced apart lower conveyors will be appreciated. The vertically aligned spaces between the conveyors permits each label 17 to move downwardly into the path of movement of the portion of the socks 16 which bridge the spaces. In addition, the tucker 143 swings through the spaces between the pairs of conveyors, and the photoelectric cells and their respective light sources are vertically aligned with the spaces between the pairs of conveyors, the light beam being interrupted only by the moving socks and not by the conveyor themselves.

Use of the tucker 143 may also be avoided when the article being labeled has a circular cross-section, such as a ball of twine. In such a case, the upper pair of conveyors 14 and 15 is caused to move faster than the lower pair of conveyors, with the result that the article is rotated in a clockwise direction, as viewed in FIG. 3, causing the label 17 to be wrapped completely around the article.

In view of the foregoing, it is to be understood that the description herein of a preferred embodiment according to the invention is set forth as an example thereof and is not to be construed or interpreted as a limitation on the claims which follow and define the invention.

What is claimed is:

1. Apparatus for applying labels to articles comprising:

a. means for continuously feeding articles along a path of travel, said article-feeding means including two side-by-side but spaced-apart conveyors;

b. means for holding the articles on the conveyors as the articles are fed;

c. means for feeding labels through the space between said conveyors into the path of travel of the articles so that the leading edge of each article engages a label between the ends of the label, the leading portion of each label from its free leading edge past the point it is first engaged by the leading edge of an article being free of engagement with any part of the apparatus at the time the label is first engaged by the article; and d. means for pressing engaged labels to the top and bottom surfaces of the article with which it is engaged.

2. Apparatus as defined in claim 1 wherein said means for feeding labels is responsive to the movement of said articles.

3. Apparatus as defined in claim 2 wherein said means for feeding labels includes means for feeding said labels at selectable speeds.

4. Apparatus as defined in claim 2 wherein said means for feeding articles moves the articles along a substantially linear path; and said label feeding means moves each label towards said path with a velocity whose component in the direction of said linear path is substantially equal to the rate at which the articles are moved.

5. Apparatus as defined in claim 2 including means responsive to the movement of said labels for terminating operation of said label feeding means after each label is fed.

6. Apparatus as defined in claim 1 wherein said means for feeding articles includes means for driving the conveyors at selectable speeds.

7. Apparatus as defined in claim 1 wherein said means for holding the articles includes a second conveyor spaced from said side-by-side conveyors, said side-by-side and second conveyors having opposing faces at lease partially defining the path of travel of the articles.

8. Apparatus as defined in claim 7 including means for driving the second conveyor at selectable speeds independent of the speed of movement of the first conveyor.

9. Apparatus as defined in claim 7 including means for varying the distance between said opposing faces so as to enable said conveyors to accommodate articles of various sizes between them.

10. Apparatus as defined in claim 9 including means for maintaining said conveyor belts parallel to each other throughout the adjustment of distance between them.

11. Apparatus as defined in claim 9 wherein one of said conveyor belts is mounted to move toward and away from the other conveyor belt, and said label-feeding means is mounted to move with said movable conveyor belt.

12. Apparatus as defined in claim 1 wherein each of said labels is long enough to be wrapped around the trailing edge of an article, and including means for tucking the trailing edge of said label against the bottom surface of said article.

13. Apparatus as defined in claim 12 wherein said means for tucking the labels includes means responsive to the movement of said articles for actuating the tucking means.

14. Apparatus as defined in claim 13 wherein said means responsive to the movement of said articles is responsive to the movement of the trailing edge of said article past a predetermined point along the path of travel of the article.

15. Apparatus as defined in claim 13 wherein said responsive means includes a photoelectric cell arranged to sense movement of the articles.

16. Apparatus as defined in claim 13 including means for adjusting the position of said responsive means along the direction of travel of said articles.

17. Apparatus as defined in claim 1 including means responsive to movement of an article for initiating the feeding of a label.

18. Apparatus as defined in claim 1 including means responsive to movement of an article for initiating the feeding of a label, and means for adjusting the position of said responsive means along the direction of travel of said articles.

19. Apparatus as defined in claim 1 wherein said labelpressing means includes a pair of rotating spaced apart rollers having opposed surfaces between which the label-bearing article moves in the direction of movement of the opposed surfaces.

20. Apparatus as defined in claim 1 including means for tucking the trailing edge of a label against the bottom surface of an article, and means for moving said tucking means into and out of the space between said conveyors.

* * * * *